US006305101B2

(12) United States Patent
Chemello

(10) Patent No.: US 6,305,101 B2
(45) Date of Patent: Oct. 23, 2001

(54) INNER LINER FOR A BOOT

(75) Inventor: Jean-Pierre Chemello, Annecy le Vieux (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/353,341

(22) Filed: Jul. 15, 1999

(30) Foreign Application Priority Data

Jul. 16, 1998 (FR) ..... 98 09247

(51) Int. Cl.[7] ..... A43B 19/00

(52) U.S. Cl. ..... 36/10; 36/72 R; 36/77 R; 36/54

(58) Field of Search ..... 36/10, 72 R, 77 R, 36/117.6, 133, 96, 54

(56) References Cited

U.S. PATENT DOCUMENTS

| | | | |
|---|---|---|---|
| Re. 24,897 | * | 11/1960 | Schlecht . |
| 129,398 | * | 7/1872 | Crowe . |
| 260,024 | * | 6/1882 | Holbrook . |
| 939,639 | * | 11/1909 | Sack . |
| 1,582,232 | * | 4/1926 | Vinzant . |
| 2,384,927 | * | 9/1945 | Julianelli . |
| 3,175,292 | * | 3/1965 | MacQuaid et al. . |
| 3,206,874 | * | 9/1965 | Ellis et al. . |
| 3,481,055 | * | 12/1969 | Herman . |
| 3,561,142 | * | 2/1971 | Streit, Sr. et al. . |
| 3,841,004 | * | 10/1974 | Gray et al. . |
| 4,333,248 | * | 6/1982 | Samuels . |
| 4,920,666 | * | 5/1990 | Marega . |
| 5,185,944 | * | 2/1993 | Okajima . |
| 5,289,645 | | 3/1994 | Marega et al. ..... 36/54 |
| 5,499,459 | * | 3/1996 | Tomaro . |
| 5,778,566 | * | 7/1998 | Edauw et al. . |
| 5,933,987 | * | 8/1999 | Demarchi . |

FOREIGN PATENT DOCUMENTS

| | | |
|---|---|---|
| 9412151 | 11/1994 | (DE) . |
| 19527319 | 1/1997 | (DE) . |
| 0427321 | 5/1991 | (EP) . |
| 0846426 | 6/1998 | (EP) . |
| 2470551 | 6/1981 | (FR) . |
| 2682858 * | 4/1993 | (FR) . |
| 2719198 | 11/1995 | (FR) . |
| 1138107 | 9/1986 | (IT) . |
| 1138921 | 9/1986 | (IT) . |
| WO97/32499 | 9/1997 | (WO) . |

* cited by examiner

*Primary Examiner*—Ted Kavanaugh
(74) *Attorney, Agent, or Firm*—Greenblum & Bernstein P.L.C.

(57) ABSTRACT

An inner liner for a boot having a sole and an upper provided with a foot entry opening in its front upper part. The upper is made of several pieces, the several pieces being connected by a mode of assembly that define connecting lines. A sealing element extends continuously from the sole, where it is welded/glued, to the foot entry opening by completely housing the liner toe. The liner contributes to reinforcing and ensuring the impermeability of the boot.

14 Claims, 2 Drawing Sheets

INNER LINER FOR A BOOT

BACKGROUND OF THE INVENTION

1. Field of the Invention

The present invention relates to a boot inner liner whose upper is made from one or several pieces which are cut out along a predetermined contour, then mounted together by means of stitches, adhesive, welding, etc., for example.

2. Description of Background and Relevant Information

Liners of the above-mentioned type are widely implemented in sport boots having a more or less rigid outer envelope, commonly called a "shell." These liners are adapted to ensure the interface between the shell and the user's foot. They are especially provided with a sole on which the upper is "glued-welded" and, in order to allow passage of the user's foot, their upper is provided, just like the boot shells, with a foot entry opening in its upper front part. In fact, it is these liners that determine the comfort and technicality of the boot.

In a known manner, these characteristics of comfort and technicality are obtained by adjusting the thickness and firmness of the wall of the liner upper, which can be obtained from one or several pieces of different types. More specifically, the upper is most often constituted of one or several pieces which are cut out along a pattern, according to a predetermined contour, then the upper is formed and mounted by assembly means that define stitchings, gluing, welding, etc., i.e., connecting lines.

By this arrangement, each cut out and/or outlined piece can be provided with specific characteristics perfectly adapted to the areas of the foot that it covers and to the technical effects anticipated in the shell-foot interface. By way of example, patent EP 0 427 321 and utility certificate FR 2 719 198 teach these types of liners.

Also known are liners whose upper is formed with one or several pieces molded along a predetermined contour, these pieces being potentially pre-shaped, then formed and mounted by assembly means that define the connecting lines, such as stitching, welding, etc. Still, by way of example, patents IT 1 138 921 and IT 1 138 107, which disclose liners made in this manner, can be cited.

These different ways of obtaining the upper of liners from one or several previously cut out pieces, which are then mounted by assembly means, allow modifying and adjusting the size and/or fitting volume by merely correcting, right before mounting, the contour of the different component piece and/or pieces, and possibly varying very substantially the relative position of the assembly means on the contour of the pieces. In addition, they allow designing liners with an upper whose structure is composed of several pieces of different types and characteristics that are predetermined depending on the sensitivity of various zones of the user's foot and the technical effects sought. Thus, the parameters of comfort and technicality can be easily respected.

For all of these advantageous reasons, manufacturing ease, great freedom of composition, easy adjustment, etc., most of the known liners have their upper formed and mounted by assembly means after the component piece and/or pieces have been cut out.

These liners, however, are found to be badly adapted when impermeability of the boot is sought. This is especially the case for boots adapted to be used in snow, such as boots for alpine skiing, mountain skiing, and cross-country skiing. Indeed, in these boots the only protection offered by the shell remains insufficient since the zone or the foot entry opening of the shell, like that of the liner, requires the use of elements for overlapping and maintaining the foot which must be movable to allow the passage of the foot. Due to this mobility of the overlapping elements in the foot entry of the shell, it is therefore not possible to provide a permanent impermeability at the area of their mutual junction and across from the shell from which they originate. Consequently, the water resulting from melted snow can easily infiltrate and penetrate inside the shell by the front thereof through the overlapping elements, either when using the boot or when putting it on or taking it off, and reach the liner through its foot entry zone, and at its toe. The covering elements for the foot entry of the liner, as well as the outer surface of the latter, are therefore subjected to the same water infiltration problem which, obviously, permeates itself easily through the pores and interstices that remain, especially along the connecting lines defined by the assembly means.

SUMMARY OF THE INVENTION

An object of the present invention is to overcome the aforementioned drawback in a simple and efficient manner while retaining the advantages procured by the forming and mounting of the liner upper after cutting out its component piece and/or pieces.

According to the invention, the inner liner for a boot has a sole and an upper provided with a foot entry opening in its upper front part. The upper is constituted of one or more pieces cut out along a predetermined contour, then formed and mounted by a mode of assembly that define connecting lines, such as stitching, welding, gluing, etc. A flexible sealing element of the liner, extending continuously from the sole up to the foot entry opening, is attached onto the toe of the liner which it encases completely, covering the connecting lines defined by the mode of assembly located there. Also, the sealing element extends overtop the foot entry opening from the toe of the liner along the zone corresponding to the front part of the foot up to the area of the instep girth.

Advantageously, the sealing element exceeds relatively on both sides of the foot entry opening, at least up to the vicinity of the liner flanks so that its possible fixing onto the component pieces of the liner upper can be achieved largely at a distance from this opening. In this way, when the water infiltration reaches the sealing element, the water is evacuated along the sides in the direction of the flanks where, due to the verticality of the latter elements, it runs off rapidly.

Through these arrangements, the liner becomes one of the components of the boot that contributes to reinforcing and ensuring the impermeability of the latter, in addition to its role of being a comfort element in the shell-foot interface.

According to a preferred embodiment, the sealing element is mountedwelded at the toe of the liner sole and then rises along the front part of the liner that it encases continuously and covers freely, its possible fixing on the flanks occurring at the edge of its contour, therefore at a distance from the foot entry opening. When fixing the sealing element, a mode of assembly can be used that defines lines of stitching, welding, gluing, etc., which can be identical to those used for the actual mounting of the liner upper. The characteristic relative to the free overlapping of the front part of the liner where the foot entry is found is very advantageous for not overly obstructing the evacuation of perspiration in the area of the front part of the foot, and for not interfering with or hindering the relative displacements of the closing elements of the liner on the foot, such as overlapping transverse flaps or the edges of a longitudinal opening associated to a tongue. In order to obtain a good impermeability, the sealing element extends continuously from the toe of the liner sole up to the area of the instep girth.

According to another embodiment, the sealing element extends largely along the liner flanks such that it practically encases the entire front part, or toe of the liner, that corresponds to the zone of the front part of the foot and of the instep girth by including the liner flanks. In this construction, the sealing element can be merely fixed-welded to the sole and be completely free with respect to the liner flanks. For example, it can have characteristics of elasticity ensuring that it is pressed against the flanks and toe of the liner.

BRIEF DESCRIPTION OF DRAWINGS

The invention will be better understood through the following description with reference to the attached schematic drawings showing, by way of example, an embodiment of the liner, in which.

DETAILED DESCRIPTION OF THE INVENTION

Figure 2:
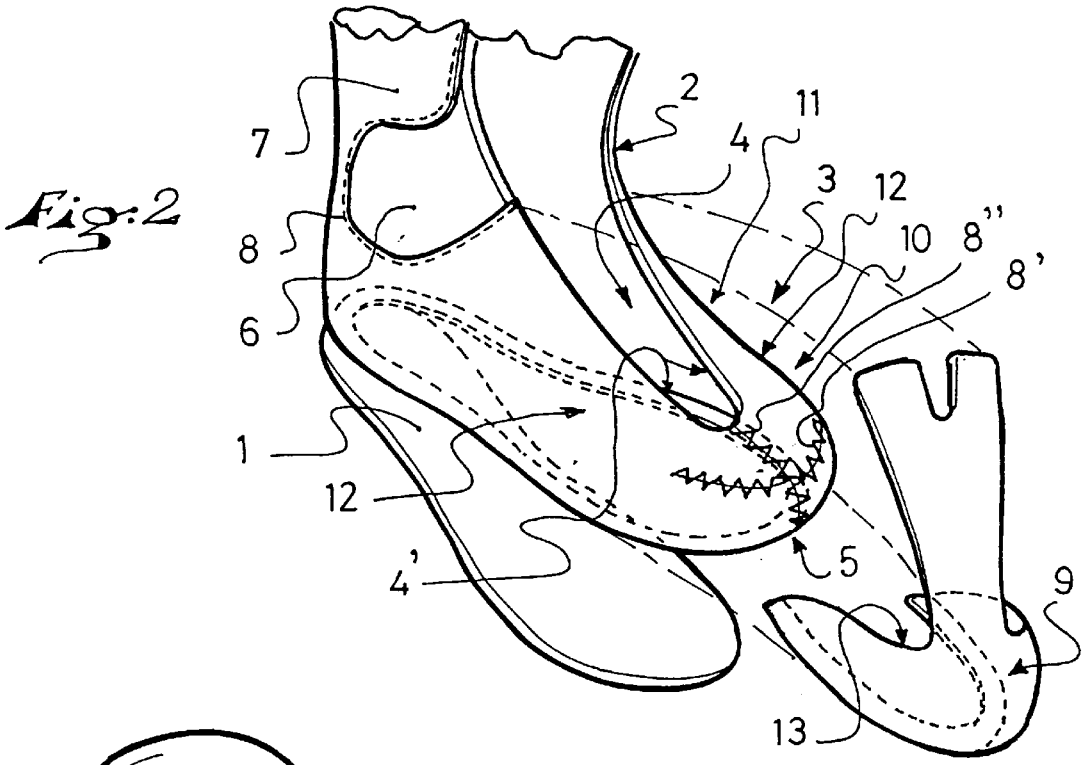
FIG. 2 shows the liner of FIG. 1 during mounting with its sealing element and its sole.
Figure 1:
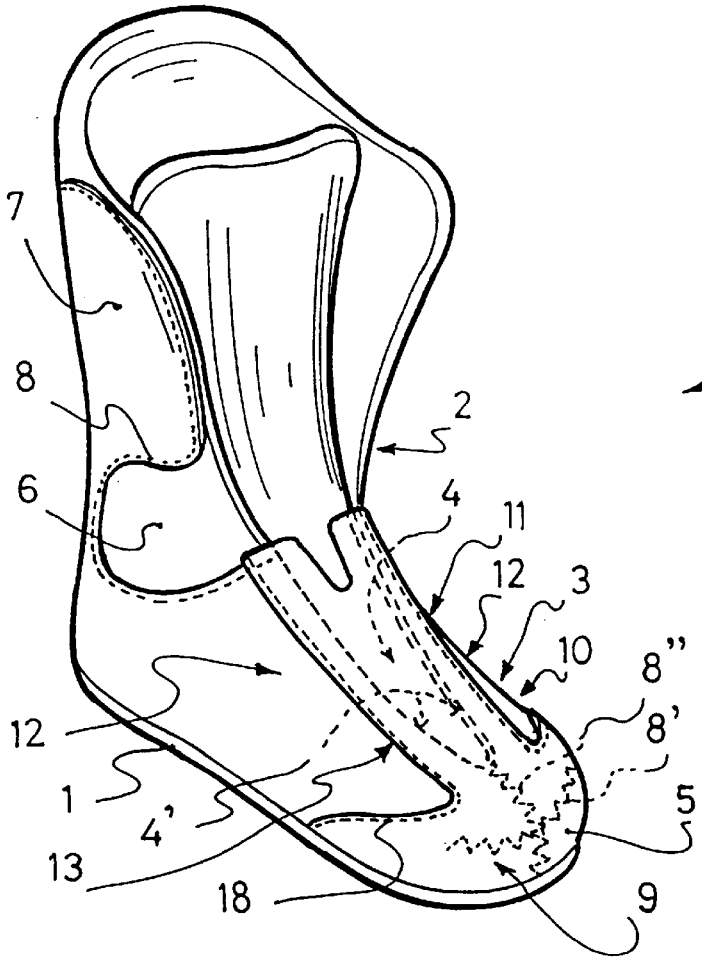
FIG. 1 shows, in a perspective view, a front foot entry liner provided with an sealing element according to the invention.

The boot represented in FIGS. 1 and 2 has a sole 1 and an upper 2 which is provided with a foot entry opening 4 in its upper front part 3 located substantially behind the toe 5 of the liner. The upper 2 is constituted, in this example, of several pieces 6, 7, which are cut out along a predetermined peripheral contour, then assembled together in a predetermined form by a mode of assembly that defines connecting lines 8, 8', 8". More specifically, these connecting lines 8, 8', 8" are constituted, depending on the mounting process used, by stitching, welding, or gluing lines, and the assembly uses threads, welds, or glue, or any combination of same, thereby constituting a permanent assembly means for permanently securing the pieces together.

Figure 3:
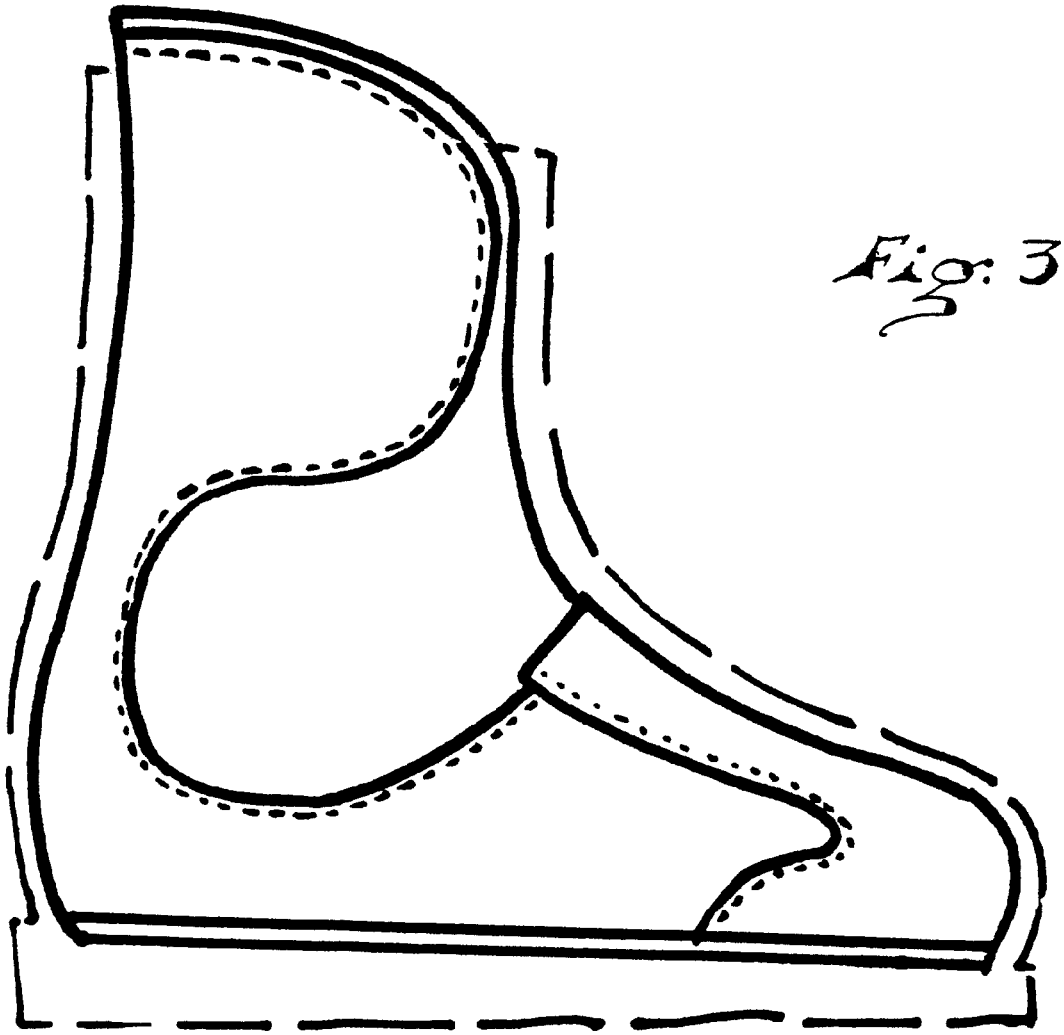
FIG. 3 shows the liner of FIGS. 1 and 2 and, in broken lines, an external shell of a boot.

According to the invention, a flexible sealing element 9 of the liner is attached onto the toe 5 of the liner and extends continuously from the sole 1, where it is mounted by welding, preferably, up to the foot entry opening 4. This sealing element 9 covers, in the area of the toe 5 of the liner and on the upper front part 3 of the latter, the existing connecting lines 8', 8". To this end, the sealing element 9 extends overtop the foot entry opening 4, consequently enclosing it, from the area 10 corresponding to the front part of the foot up to the area 11 of the instep girth. Thus, if assembly elements 8, 8', 8" are located on the edges 4' of the foot entry opening 4, their connecting lines are also covered and protected by the sealing element 9. In order to ensure a good protection against water infiltration, which is capable of passing through the boot shell (as shown in FIG. 3) in which the liner is arranged, the sealing element overlaps the foot entry opening 4 of the liner on both sides and is extended on each side, at least up to the vicinity of the liner flanks 12. Through these arrangements, all of the upper front part 3 of the liner is protected from any water infiltration. Additionally, if such infiltration occurs, water is automatically evacuated along the sides in the direction of the flanks 12 where, because of their verticality, it runs off rapidly. The possibility of water saturation on the liner flanks 12 is therefore reduced.

According to construction detail, the sealing element 9, freely overlaps the foot entry opening 4 in order to, among other things, allow its edges to be displaced reciprocally to the edges 4' of the foot entry opening, depending on the extent of tightening of the liner on the user's foot. In this embodiment, the sealing element 9, is fixed by an assembly means at the edge of its contour 13 onto the liner flanks 12, the assembly means in the form of stitching lines 18 thus being generally disposed at a distance form the foot entry opening 4 and in its vertically zone of the liner flanks 12.

Advantageously, the sealing element is provided with characteristics of elasticity ensuring that it is pressed on the toe 5 of the liner and on the foot entry opening 4. The liner thus remains easy to open for the passage of the user's foot when putting the boot on or taking it off.

The sealing element 9 can obviously cover the toe 5 of the liner more so and have contours other than the contour 13. For example, it can encase the entire toe 5 of the liner and the foot entry opening 4 at least up to the area 11 corresponding to the user's instep girth by including the liner flanks 12. In this example of construction, the sealing element 9 can be merely fixed/welded to the sole 1 and remain completely free with respect to the liner flanks 12 that it envelops more or less tightly, whether it is provided to be elastic or not. According to the invention, both the stitching 18 and the fixing/welding of the sealing element 9 to the sole 1 can be regarded as providing for a "permanent" attachment. In addition, FIG. 1 depicts the liner in its assembled state, with a tongue (not labeled) positioned beneath the sealing element 9.

The instant application is based upon French Patent Application No. 98.09247, filed Jul. 16, 1998, the disclosure of which is hereby incorporated by reference thereto in its entirety, and the priority of which is hereby claimed under 35 USC 119.

What is claimed is:

1. A boot comprising:

an external shell;

a liner positioned within said external shell, said liner comprising:

a sole;

an upper permanently affixed to said sole, said upper having a predetermined form, said upper comprising a forwardmost portion, a longitudinally extending foot entry opening, and an instep girth area, said forwardmost portion of said upper comprises a forwardmost end of said upper;

said upper comprising at least one piece, each of said at least one piece having a determinate respective peripheral contour, said at least one piece being defined at least by connecting lines permanently connecting said upper into said predetermined form;

said upper further comprising a flexible sealing element extending continuously at least from said forwardmost end rearwardly to said foot entry opening, said flexible sealing element covering said connecting lines at least from said forwardmost end of said upper to said foot entry opening, said sealing element extending over said foot entry opening at least between a forwardmost end of said foot entry opening to said instep girth area of said upper.

2. A boot according to claim 1, wherein:

said upper further comprises opposite flanks;

said sealing element overlaps said foot entry opening on opposite lateral sides at least to a vicinity of said flanks, said sealing element being permanently affixed at said vicinity of said flanks.

3. A boot according to claim 1, wherein:

said sealing element freely covers edges of said foot entry opening of said liner.

4. A boot according to claim 1, wherein:

said sealing element has characteristics of elasticity ensuring that said sealing element is pressed on said toe area and on said foot entry opening.

5. A boot according to claim 1, wherein:

said liner further comprises a tongue extending beneath said sealing element.

6. A boot according to claim 1, wherein:

said connecting lines are defined by stitching.

7. A boot according to claim 1, wherein:

said connecting lines are defined by welds.

8. A boot according to claim 1, wherein:

said connecting lines are defined by glue.

9. A boot according to claim 1, wherein:

said connecting lines are defined by a plurality of stitching, glue, and welds.

10. A boot according to claim 1, wherein:

said sealing element is permanently assembled to said at least one piece of said upper at least rearwardly of said connecting lines.

11. A boot according to claim 1, wherein:

said foot entry opening extends along said instep girth area.

12. A boot according to claim 1, wherein:

said sealing element is permanently affixed to said forwardmost portion of said upper of said liner at least along lines laterally spaced from opposed edges of said foot entry opening.

13. A boot according to claim 1, wherein:

said flexible sealing element is permanently affixed against movement with respect to and along said upper of said liner.

14. A boot comprising:

an external shell;

a liner positioned within said external shell, said liner comprising:

a sole;

an upper permanently affixed to said sole, said upper having a predetermined form, said upper comprising a forwardmost portion, a front part having a longitudinally extending foot entry opening, and an instep girth area;

said upper comprising at least one piece, each of said at least one piece having a determinate respective peripheral contour, said at least one piece being defined at least by connecting lines permanently connecting said upper into said predetermined form;

said upper further comprising a flexible sealing element extending continuously at least from said forwardmost portion rearwardly to said foot entry opening, said flexible sealing element permanently assembled to said forwardmost portion and covering said connecting lines at least between said forwardmost portion and said foot entry opening, said sealing element extending over said foot entry opening at least between a forwardmost end of said foot entry opening to said instep girth area of said upper;

wherein said sealing element encases an entirety of said forwardmost portion of said upper and encases an entirety of an area of said foot entry opening between said forwardmost end of said foot entry opening rearward to said instep girth area.

* * * * *